US011798738B2

(12) United States Patent
Tadai et al.

(10) Patent No.: US 11,798,738 B2
(45) Date of Patent: Oct. 24, 2023

(54) MAGNETIC POWDER, METHOD FOR PRODUCING MAGNETIC POWDER, POWDER MAGNETIC CORE, AND COIL PART

(71) Applicant: SEIKO EPSON CORPORATION, Tokyo (JP)

(72) Inventors: Momo Tadai, Suwa (JP); Takuya Miyakawa, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 427 days.

(21) Appl. No.: 16/938,001

(22) Filed: Jul. 24, 2020

(65) Prior Publication Data

US 2021/0027940 A1 Jan. 28, 2021

(30) Foreign Application Priority Data

Jul. 25, 2019 (JP) ..... 2019-136813

(51) Int. Cl.

| | |
|---|---|
| ***H01F 41/02*** | (2006.01) |
| ***H01F 1/24*** | (2006.01) |
| ***H01F 1/33*** | (2006.01) |
| ***H01F 17/06*** | (2006.01) |
| ***H01F 27/28*** | (2006.01) |
| ***H01F 27/32*** | (2006.01) |
| ***H01F 27/255*** | (2006.01) |

(52) U.S. Cl.

CPC ..... *H01F 41/0246* (2013.01); *H01F 1/24* (2013.01); *H01F 1/33* (2013.01); *H01F 17/062* (2013.01); *H01F 27/255* (2013.01); *H01F 27/2823* (2013.01); *H01F 27/32* (2013.01); *Y10T 428/32* (2015.01)

(58) Field of Classification Search

None

See application file for complete search history.

(56) References Cited

U.S. PATENT DOCUMENTS

| | | | | |
|---|---|---|---|---|
| 7,544,417 | B2 * | 6/2009 | Maeda | B22F 1/16 428/407 |
| 8,797,137 | B2 * | 8/2014 | Watanabe | H01F 41/0246 336/200 |
| 9,493,866 | B2 * | 11/2016 | Otsuka | H01F 41/0246 |
| 10,741,316 | B2 * | 8/2020 | Skarman | H01F 1/24 |

(Continued)

FOREIGN PATENT DOCUMENTS

| | | |
|---|---|---|
| JP | 2007-088156 A | 4/2007 |
| JP | 2012-238828 A | 12/2012 |

(Continued)

OTHER PUBLICATIONS

Abstract/Machine Translation of JP 2013-222827 A. (Year: 2013).*

*Primary Examiner* — Kevin M Bernatz

(74) *Attorney, Agent, or Firm* — Oliff PLC

(57) ABSTRACT

A magnetic powder includes a core portion containing a soft magnetic material, a foundation layer that is provided at a surface of the core portion, that contains an oxide of the soft magnetic material, and that has an average thickness of 0.1 nm or more and less than 10 nm, and an insulating layer that is provided at a surface of the foundation layer, and that contains an organosiloxane compound as a main material, wherein the organosiloxane compound has a C/Si atomic ratio of 0.01 or more and 2.00 or less.

12 Claims, 5 Drawing Sheets

(56) References Cited

U.S. PATENT DOCUMENTS

| | | | | |
|---|---|---|---|---|
| 10,811,176 | B2 * | 10/2020 | Futamata | H01F 3/00 |
| 10,882,109 | B2 * | 1/2021 | Enomura | C01G 49/02 |
| 2008/0044679 | A1 * | 2/2008 | Maeda | H01F 41/0246 427/127 |
| 2009/0226218 | A1 * | 9/2009 | Takatsuka | G03G 9/1136 430/111.1 |
| 2010/0028195 | A1 | 2/2010 | Maeda et al. | |
| 2012/0274437 | A1 | 11/2012 | Matsuura et al. | |
| 2012/0274438 | A1 | 11/2012 | Hachiya et al. | |
| 2014/0049348 | A1 | 2/2014 | Matsuura et al. | |
| 2014/0132383 | A1 | 5/2014 | Matsuura et al. | |
| 2014/0139311 | A1 | 5/2014 | Matsuura et al. | |
| 2016/0163448 | A1 | 6/2016 | Matsuura et al. | |

FOREIGN PATENT DOCUMENTS

| | | | | |
|---|---|---|---|---|
| JP | 2013222827 | A | * | 10/2013 |
| JP | 2018-120966 | A | | 8/2018 |

* cited by examiner

MAGNETIC POWDER, METHOD FOR PRODUCING MAGNETIC POWDER, POWDER MAGNETIC CORE, AND COIL PART

The present application is based on, and claims priority from JP Application Serial Number 2019-136813, filed on Jul. 25, 2019, the disclosure of which is hereby incorporated by reference herein in its entirety.

BACKGROUND

1. Technical Field

The present disclosure relates to a magnetic powder, a method for producing a magnetic powder, a powder magnetic core, and a coil part.

2. Related Art

In a magnetic powder used in an inductor or the like, it is necessary to suppress an eddy current flowing between particles by subjecting the surfaces of the particles to an insulation treatment. Therefore, various methods for forming an insulating coating film at the surfaces of particles of a magnetic powder have been studied.

For example, JP-A-2012-238828 (Patent Document 1) discloses a magnetic material composed of a particle molded body that includes a plurality of metal particles composed of a soft magnetic alloy and an oxide coating film formed at the surfaces of the metal particles, and that has a coupling portion formed by the oxide coating films or a coupling portion formed by the metal particles. In such a magnetic material, the insulating property of the particle molded body is ensured by the oxide coating film.

On the other hand, when an inductor is used in a high frequency circuit, the impedance of the particle molded body is required to be adjusted in some cases. In such a case, among the elements constituting the impedance of the particle molded body, by adjusting the capacitive reactance, the impedance can be adjusted.

As one of the methods for adjusting the capacitive reactance, changing the thickness of the oxide coating film is considered. However, when the thickness of the oxide coating film is made thin, an eddy current loss between the particles is increased, and on the other hand, when the thickness of the oxide coating film is made thick, the magnetic permeability of the particle molded body is decreased. Therefore, the method for changing the thickness of the oxide coating film has many problems.

On the other hand, as another method for adjusting the capacitive reactance for adjusting the impedance of the particle molded body, changing the permittivity of an insulating layer such as an oxide coating film is considered. It is necessary to change the composition of the insulating layer for changing the permittivity of the insulating layer. A particle molded body capable of relatively easily adjusting the capacitive reactance while suppressing a decrease in magnetic permeability by changing the composition of the insulating layer has been demanded.

SUMMARY

A magnetic powder according to an application example of the present disclosure includes a core portion containing a soft magnetic material, a foundation layer that is provided at a surface of the core portion, that contains an oxide of the soft magnetic material, and that has an average thickness of 0.1 nm or more and less than 10 nm, and an insulating layer that is provided at a surface of the foundation layer, and that contains an organosiloxane compound as a main material, wherein the organosiloxane compound has a C/Si atomic ratio of 0.01 or more and 2.00 or less.

DESCRIPTION OF EXEMPLARY EMBODIMENTS

Hereinafter, preferred embodiments of a magnetic powder, a method for producing a magnetic powder, a powder magnetic core, and a coil part according to the present disclosure will be described in detail based on the accompanying drawings.

1. First Embodiment

First, a magnetic powder according to a first embodiment will be described.

Figure 1:
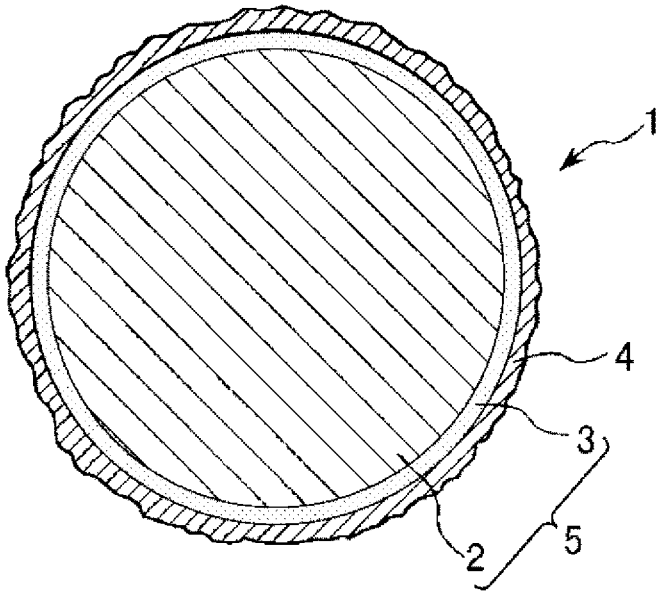
FIG. 1 is a cross-sectional view schematically showing one particle of a magnetic powder according to a first embodiment.

FIG. 1 is a cross-sectional view schematically showing one particle of the magnetic powder according to the first embodiment. In the following description, one particle of the magnetic powder is also referred to as "a magnetic particle".

A magnetic particle 1 shown in FIG. 1 includes a core portion 2, a foundation layer 3 provided at a surface of the core portion 2, and an insulating layer 4 provided at a surface of the foundation layer 3. Hereinafter, the respective portions will be described.

1.1 Core Portion

The core portion 2 is a particle containing a soft magnetic material. Examples of the soft magnetic material contained in the core portion 2 include pure iron, various types of Fe-based alloys such as an Fe—Si-based alloy such as silicon steel, an Fe—Ni-based alloy such as permalloy, an Fe—Co-based alloy such as permendur, an Fe—Si—Al-based alloy such as Sendust, and an Fe—Cr—Si-based alloy, and an Fe—Cr—Al-based alloy, and other than these, various types of Ni-based alloys, and various types of Co-based alloys. Among these, various types of Fe-based alloys are preferably used from the viewpoint of magnetic characteristics such as magnetic permeability and magnetic flux density, and productivity such as cost.

The crystalline property of the soft magnetic material is not particularly limited, and the soft magnetic material may be crystalline or non-crystalline (amorphous) or microcrystalline (nanocrystalline). Among these, the soft magnetic material preferably contains an amorphous or microcrystalline material, and more preferably contains an amorphous material. When such a material is contained, the coercive force becomes small, and therefore, it also contributes to reduction in hysteresis loss. Therefore, by using a soft magnetic material exhibiting such a crystalline property, the magnetic particle 1 capable of producing a powder magnetic core having a low iron loss while achieving both a high magnetic permeability and a high magnetic flux density can be realized.

Examples of the soft magnetic material capable of forming an amorphous material and a microcrystalline material include Fe-based alloys such as Fe—Si—B-based, Fe—Si—B—C-based, Fe—Si—B—Cr—C-based, Fe—Si—Cr-based, Fe—B-based, Fe—P—C-based, Fe—Co—Si—B-based, Fe—Si—B—Nb-based, and Fe—Zr—B-based alloys, Ni-based alloys such as Ni—Si—B-based and Ni—P—B-based alloys, and Co-based alloys such as Co—Si—B-based alloys.

In the soft magnetic material, a material having a different crystalline property may be mixed.

The core portion 2 preferably contains the soft magnetic material as a main material, and may contain an impurity other than this. The main material refers to a material occupying 50% or more of the core portion 2 in a mass ratio. The content ratio of the soft magnetic material in the core portion 2 is preferably 80 mass % or more, preferably 90 mass % or more. According to this, the core portion 2 exhibits a favorable soft magnetic property.

To the core portion 2, an arbitrary additive may be added other than the soft magnetic material. Examples of such an additive include various types of metal materials, various types of non-metal materials, and various types of metal oxide materials.

Such a core portion 2 may be a particle produced by any method. Examples of a production method include various types of atomization methods such as a water atomization method, a gas atomization method, and a spinning water atomization method, other than these, a reducing method, a carbonyl method, and a pulverization method. Among these, as the core portion 2, one produced by an atomization method is preferably used. According to the atomization method, a powder having a small and uniform particle diameter can be efficiently produced.

1.2 Foundation Layer

The foundation layer 3 is provided at a surface of the core portion 2, and contains an oxide of the soft magnetic material contained in the core portion 2. The oxide of the soft magnetic material refers to an oxide of an element constituting the soft magnetic material. Therefore, the core portion 2 and the foundation layer 3 have a common element.

The foundation layer 3 is located between the core portion 2 and the below-mentioned insulating layer 4. By providing such a foundation layer 3, the adhesion between the core portion 2 and the insulating layer 4 can be enhanced. According to this, peeling of the insulating layer 4 or moisture penetration or the like between the insulating layer 4 and the core portion 2 can be suppressed.

The foundation layer 3 contains the oxide of the soft magnetic material, and therefore has an insulating property. Therefore, not only the below-mentioned insulating layer 4, but also the foundation layer 3 acts to enhance the insulating property between the magnetic particles 1.

The oxide contained in the foundation layer 3 depends on the composition of the soft magnetic material contained in the core portion 2, but examples thereof include iron oxide, chromium oxide, nickel oxide, cobalt oxide, manganese oxide, silicon oxide, boron oxide, phosphorus oxide, aluminum oxide, magnesium oxide, calcium oxide, zinc oxide, titanium oxide, vanadium oxide, and cerium oxide. Further, the foundation layer 3 may contain two or more types among these.

The foundation layer 3 may contain a material other than the oxide of the soft magnetic material described above.

The average thickness of the foundation layer 3 is 0.1 nm or more and less than 10 nm. By setting the average thickness of the foundation layer 3 within the above range, when a powder magnetic core is produced using the magnetic particle 1, a decrease in the magnetic permeability of the powder magnetic core can be prevented. When the average thickness of the foundation layer 3 is less than the above lower limit, the function of the foundation layer 3 is not sufficiently exhibited. In particular, when a phosphate or the like that is easily ionized is contained in the foundation layer 3, the impedance of the insulating layer 4 may sometimes be decreased accompanying the leakage of an electric current due to the ions. On the other hand, when the average thickness of the foundation layer 3 exceeds the above upper limit, the ratio of the volume of the foundation layer 3 in the powder magnetic core is increased to cause a decrease in the magnetic permeability.

Further, the average thickness of the foundation layer 3 is preferably 1.0 nm or more and 8.0 nm or less, more preferably 2.0 nm or more and 7.0 nm or less.

The average thickness of the foundation layer 3 is determined as an average value of the film thickness measured at 5 or more sites by magnification observation of a cross section of the magnetic particle 1 with a transmission electron microscope or the like.

The foundation layer 3 preferably covers the entire surface of the core portion 2, but may contain a discontinuous portion, that is, a missing portion.

The content ratio of the oxide of the soft magnetic material in the foundation layer 3 is not particularly limited, but is preferably 10 mass % or more, more preferably 50 mass % or more. According to this, the above-mentioned effect is more sufficiently exhibited.

1.3 Insulating Layer

The insulating layer 4 is provided at a surface of the foundation layer 3, and contains an organosiloxane compound as a main material. The organosiloxane compound is a compound containing a siloxane bond having an organic group. The organic group is an atomic group containing carbon and hydrogen. The main material refers to a material constituting 50% or more of the insulating layer 4 in a mass ratio.

Specific examples of the organosiloxane compound include dimethylpolysiloxane, methylphenylpolysiloxane, amino-modified silicone, fatty acid-modified polysiloxane, alcohol-modified silicone, aliphatic alcohol-modified polysiloxane, polyether-modified silicone, epoxy-modified silicone, fluorine-modified silicone, cyclic silicone, and alkyl-modified silicone. The organosiloxane compound contains one type or two or more types among these.

Examples of the organic group include an alkyl group, an alkenyl group, an aralkyl group, and an aryl group.

The content ratio of the organosiloxane compound in the insulating layer 4 is preferably 70 mass % or more, more preferably 90 mass % or more.

In the insulating layer 4, a material other than the organosiloxane compound may be contained in a state of a mixture. Examples of the material other than the organosiloxane compound include a fluorine compound and a hydrocarbon compound.

In general, as the basic constituent unit of the organosiloxane compound, an M unit in which one oxygen atom and three organic groups or the like are bound to a silicon atom, a D unit in which two oxygen atoms and two organic groups or the like are bound to a silicon atom, a T unit in which three oxygen atoms and one organic group or the like are bound to a silicon atom, and a Q unit in which four oxygen atoms are bound to a silicon atom are exemplified. To a silicon atom, an atom or the like other than these may be bound.

In the organosiloxane compound, by appropriately combining such 4 types of basic constituent units, the ratio of silicon atom and carbon atom can be changed.

Here, in the organosiloxane compound according to this embodiment, the ratio of the number of carbon atoms to the number of silicon atoms, that is, the C/Si atomic ratio is 0.01 or more and 2.00 or less. If the ratio is within such a range, the permittivity of the insulating layer 4 can be appropriately changed without largely decreasing the direct current resistance of the insulating layer 4. According to this, the capacitive reactance can be easily adjusted, and therefore, when a powder magnetic core is produced, the impedance can be easily adjusted according to the frequency to be used of the powder magnetic core.

The impedance Z of the powder magnetic core is represented by: $Z=R+j|X_L-X_C|$. Here, R represents a direct current resistance, j represents an imaginary unit, $X_L$ represents an inductive reactance, and $X_C$ represents a capacitive reactance.

The frequency band to be used in the powder magnetic core is a resonance frequency or less, and therefore, the capacitive reactance $X_C$ satisfies the relationship: $X_C>X_L$ with the inductive reactance $X_L$. Therefore, when the impedance Z is increased, the imaginary part of the above formula can be increased by increasing the capacitive reactance $X_C$ as much as possible, and as a result, the impedance Z can be increased. On the other hand, an insulating film tuned to the frequency to be used is needed depending on the specification of a circuit to be used in the powder magnetic core. The C/Si atomic ratio of the insulating film is adjusted in consideration of such a case.

The C/Si atomic ratio is set to preferably 0.30 or more and 1.70 or less, more preferably 0.80 or more and 1.50 or less.

Such a C/Si atomic ratio can be specified by, for example, X-ray photoelectron spectroscopy or the like.

1.4 Magnetic Powder

As described above, the magnetic powder according to this embodiment includes the core portion 2 containing a soft magnetic material, the foundation layer 3 that is provided at a surface of the core portion 2, that contains an oxide of the soft magnetic material, and that has an average thickness of 0.1 nm or more and less than 10 nm, and the insulating layer 4 that is provided at a surface of the foundation layer 3, and that contains an organosiloxane compound as a main material. Then, the C/Si atomic ratio of the organosiloxane compound is 0.01 or more and 2.00 or less.

According to such a magnetic powder, as described above, when a powder magnetic core is produced, the capacitive reactance can be easily adjusted. As a result, the magnetic particle 1 (magnetic powder) capable of producing a powder magnetic core capable of easily adjusting the impedance according to the frequency to be used can be realized. In addition, in the magnetic particle 1, the film thickness of the foundation layer 3 and the insulating layer 4 can be made thin, and therefore, when a powder magnetic core is produced, a decrease in the magnetic permeability thereof can be suppressed.

Further, by optimizing the composition of the organosiloxane compound as described above, the heat resistance of the insulating layer 4 can be enhanced. Therefore, even when a powder magnetic core produced using the magnetic particle 1 is used in a high temperature environment, reliability can be ensured over a long period of time.

The average thickness of the insulating layer 4 is preferably 60 nm or less, but is more preferably set to 5 nm or more and 36 nm or less, and further more preferably set to 10 nm or more and 30 nm or less. When the average thickness is within such a range, the insulating layer 4 has a sufficient direct current resistance. In addition, when a powder magnetic core is produced using the magnetic particle 1, the ratio of the volume of the insulating layer 4 in the powder magnetic core is suppressed, and a sufficiently high magnetic permeability can be obtained.

The average thickness of the insulating layer 4 is determined as an average value of the film thickness measured at 5 or more sites by magnification observation of a cross section of the magnetic particle 1 with a transmission electron microscope.

The insulating layer 4 preferably covers the entire surface of the foundation layer 3, but may contain a discontinuous portion, that is, a missing portion. Further, when the foundation layer 3 includes a discontinuous portion, the insulating layer 4 may be formed at the surface of the core portion 2.

The existence ratio of the insulating layer 4 in the magnetic particle 1 is appropriately set according to the magnetic permeability required for the powder magnetic core or the insulating property between particles, but for example, is set to preferably 0.002 parts by mass or more and 0.8 parts by mass or less, more preferably 0.005 parts by mass or more and 0.6 parts by mass or less with respect to 100 parts by mass of a portion other than the insulating layer 4 such as the core portion 2 and the foundation layer 3. According to this, the insulating layer 4 can be formed on the surface of the foundation layer 3 without excess or shortage, and a decrease in magnetic permeability when producing a powder magnetic core can be suppressed.

The average thickness of the insulating layer 4 described above can also be calculated based on the existence ratio.

The relative permittivity of the insulating layer 4 is preferably 1.0 or more and 3.2 or less, more preferably 1.5 or more and 3.0 or less. The insulating layer 4 having such a relative permittivity can realize the magnetic particle 1 capable of easily adjusting the capacitive reactance when producing a powder magnetic core. For example, by decreasing the relative permittivity of the insulating layer 4 within this range, the capacitive reactance can be decreased without decreasing the magnetic permeability of the powder magnetic core.

The relative permittivity of the insulating layer 4 can be calculated based on an analysis of the components of the insulating layer 4.

The ratio of the relative permittivity of the insulating layer 4 to the average thickness of the insulating layer 4 is preferably 0.033/nm or more and 3.2/nm or less, more preferably 0.050/nm or more and 2.5/nm or less. By setting the ratio of the relative permittivity to the average thickness within the above range, when a powder magnetic core is produced, both the suppression of a decrease in the magnetic permeability and the optimization of the impedance can be achieved.

Further, the organosiloxane compound preferably contains a silsesquioxane compound. The silsesquioxane compound refers to a compound mainly constituted by a unit (T unit) in which three oxygen atoms are bound to a silicon atom among the basic constituent units of the organosiloxane compound described above. The silsesquioxane compound refers to an organosiloxane compound having a two-dimensional or three-dimensional silsesquioxane skeleton. Examples of the structure of the silsesquioxane skeleton include a random structure, a ladder structure, and a basket structure, and it may contain any structure.

When such a silsesquioxane compound is contained, the permittivity of the insulating layer 4 can be adjusted without decreasing the direct current resistance. That is, in the silsesquioxane compound, even if the C/Si atomic ratio is changed, the direct current resistance is hardly decreased, and further, the chemical property is also hardly changed.

When the silsesquioxane compound is contained, it is preferred that 50% or more of the silicon atoms contained in the insulating layer 4 constitute the T unit, and it is more preferred that 80% or more of the silicon atoms constitute the T unit. According to this, the above-mentioned effect becomes more prominent.

The organosiloxane compound may contain a fluorine-containing group. Examples of the fluorine-containing group include a perfluoro group and a fluoroalkyl group. To a fluoroorganosiloxane compound containing such a fluorine-containing group, a low permittivity based on a fluorine atom is imparted. In addition, the fluorine-containing group can impart high water repellency, and therefore, an effect of suppressing moisture absorption can also be imparted to the magnetic particle 1.

On the other hand, the insulating layer 4 may contain a fluorine compound separately from the organosiloxane compound. That is, the insulating layer 4 may contain a fluorine atom. According to this, the relative permittivity of the insulating layer 4 can be particularly decreased.

The fluorine compound is preferably contained in the form of an organic fluorine compound containing a carbon-fluorine bond. As the organic fluorine compound, for example, a monomer having a perfluoro group or a fluoroalkyl group or a polymer thereof, or a copolymer of the monomer and another monomer is exemplified. Such a compound realizes a low permittivity based on a fluorine atom, and can also impart high water repellency, and therefore, an effect of suppressing moisture absorption can also be imparted to the magnetic particle 1.

Examples of the fluorine compound include the above-mentioned fluoroorganosiloxane compound, and other than this, polytetrafluoroethylene (PTFE), a tetrafluoroethylene-perfluoroalkyl vinyl ether copolymer (PFA), a tetrafluoroethylene-hexafluoropropylene copolymer (FEP), a tetrafluoroethylene-hexafluoropropylene-perfluoroalkyl vinyl ether copolymer (EPE), polychlorotrifluoroethylene (PCTFE), a tetrafluoroethylene-ethylene copolymer (ETFE), a chlorotrifluoroethylene-ethylene copolymer (ECTFE), and a fluorine-based urethane resin, and a compound containing one type or two or more types among these is used.

The organosiloxane compound that does not contain a fluorine-containing group and a fluorine compound may be used in combination.

In such a case, the molar ratio of the organosiloxane compound to the fluorine compound is preferably 10:90 or more and 90:10 or less, more preferably 20:80 or more and 80:20 or less. According to this, the permittivity of the insulating layer 4 can be stably adjusted within a wider range without decreasing the direct current resistance of the insulating layer 4.

The average particle diameter of the magnetic powder (the average particle diameter of an aggregate of the magnetic particles 1) is not particularly limited, but is preferably 0.2 μm or more and 10.0 μm or less, more preferably 0.3 μm or more and 4.0 μm or less. By setting the average particle diameter of the magnetic powder within the above range, the eddy current loss in the particles can be sufficiently suppressed. Accordingly, the magnetic powder capable of producing a powder magnetic core having a low iron loss can be realized.

The average particle diameter of the magnetic powder refers to a particle diameter at a cumulative frequency of 50% from a small diameter side in a cumulative frequency distribution on a volume basis obtained by a laser diffraction-type particle size distribution analyzer.

2. Second Embodiment

Next, a method for producing a magnetic powder according to a second embodiment will be described.

Figure 2:
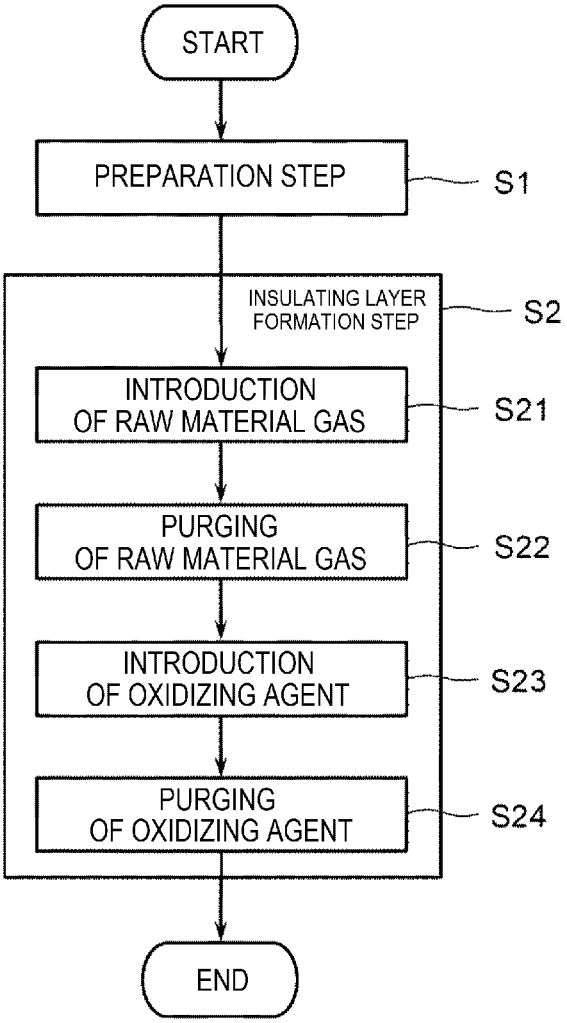
FIG. 2 is a process chart showing a method for producing a magnetic powder according to a second embodiment.

FIG. 2 is a process chart showing the method for producing a magnetic powder according to the second embodiment. In the following description, a method for producing the magnetic particle 1 shown in FIG. 1 will be described as an example.

As shown in FIG. 2, the method for producing a magnetic powder according to the second embodiment includes a preparation step S1 of preparing particles 5 with a foundation layer, each including a core portion 2 and a foundation layer 3, and an insulating layer formation step S2 of subjecting the particles 5 with a foundation layer to a film formation treatment using a first organosiloxane compound and a second organosiloxane compound having a basic constituent unit different from the first organosiloxane compound as raw materials. Hereinafter, the respective steps will be described.

2.1 Preparation Step S1

First, particles 5 with a foundation layer each including a core portion 2 and a foundation layer 3 are prepared.

When producing the particles 5 with a foundation layer, first, a metal powder containing a soft magnetic material is prepared.

Subsequently, the prepared metal powder is subjected to an oxidation treatment. By doing this, an element contained in the soft magnetic material in each particle is oxidized. As a result, an oxide is formed at the surfaces of the particles of the metal powder. Then, this oxide forms a foundation layer 3. In this manner, the particles 5 with a foundation layer each including the core portion 2 and the foundation layer 3 provided at the surface thereof are obtained.

Examples of the oxidation treatment include an immersion treatment, a steam treatment, a solvent treatment, an ozone treatment, an oxygen plasma treatment, a radical treatment, and a heating treatment.

The average thickness of the foundation layer 3 is set to 0.1 nm or more and less than 10 nm as described above. Therefore, the film thickness of the foundation layer 3 may be adjusted by adjusting the treatment time or the like of the oxidation treatment.

The foundation layer 3 is sometimes formed in the process of producing the core portion 2. In such a case, it is not necessary to perform the oxidation treatment separately.

2.2 Insulating Layer Formation Step S2

Subsequently, the particles 5 with a foundation layer are subjected to a film formation treatment. By doing this, an insulating layer 4 is formed at the surface of the foundation layer 3. In this manner, the magnetic particles 1 are obtained.

As the film formation treatment, an atomic layer deposition method, a chemical vapor deposition (CVD) method, a sputtering method, a vapor deposition method, a wet method, and the like are exemplified. In this embodiment, as one example, the formation of the insulating layer 4 by an atomic layer deposition method will be described.

In the atomic layer deposition method, first, the particles 5 with a foundation layer are introduced into a vacuum chamber. The introduced particles 5 with a foundation layer may be placed in a vessel or the like, but may be held by a magnetic force generated by an electromagnet or a permanent magnet. In the latter case, the particles 5 with a foundation layer are fixed while aligning along the lines of the magnetic force, and therefore, the particles 5 with a foundation layer can be prevented from being stirred up during an operation of decompressing the inside of the vacuum chamber. Further, the particles 5 with a foundation layer are magnetized and coupled to one another so as to align in an acicular form, and therefore, a gap between the particles 5 with a foundation layer can be sufficiently ensured. Therefore, the film forming material can penetrate and adhere to the surface of each of the particles 5 with a foundation layer in the below-mentioned film formation treatment. As a result, the insulating layer 4 can be evenly formed with a uniform thickness.

The above-mentioned oxidation treatment may also be performed in a state of holding the particles by a magnetic force generated by an electromagnet or a permanent magnet in the vacuum chamber.

Subsequently, the insulating layer 4 is formed by an atomic layer deposition method. The atomic layer deposition method is a film formation method in which two types: a raw material gas and an oxidizing agent, or more gases are used, and these gases are alternately and repeatedly introduced and discharged so as to react the raw material molecules at the surface of the foundation layer 3, whereby a film is formed. In this method, the film thickness of the insulating layer 4 can be controlled with high accuracy. Therefore, even if the film thickness of the insulating layer 4 is thin, a film can be uniformly formed. As a result, the magnetic particles 1 having a high filling property in compaction molding can be produced. Further, the raw material gas or the oxidizing agent also penetrates into a narrow gap and causes a reaction, and therefore, a film can be evenly formed.

Hereinafter, specific procedure will be described.

2.2.1 Introduction of Raw Material Gas S21

First, the inside of the chamber into which the particles 5 with a foundation layer are introduced is decompressed. Subsequently, a gas containing a precursor of a material constituting the insulating layer 4 to be formed is introduced into the chamber as a raw material gas. Specifically, a first organosiloxane compound and a second organosiloxane compound having a basic constituent unit different from the first organosiloxane compound are used as raw material gases. When the introduced raw material gas is adsorbed to the surface of the particle 5 with a foundation layer, further adsorption hardly occurs to form a multilayer. Therefore, the film thickness of the insulating layer 4 to be finally obtained can be controlled with high accuracy. Further, the raw material gas also penetrates into a portion behind or a gap and is adsorbed thereto, and therefore, the insulating layer 4 having a uniform film thickness can be formed in the end.

Examples of the first organosiloxane compound and the second organosiloxane compound contained in the raw material gas include trisdimethylaminosilane, trisdiethylaminosilane, bisdiethylaminosilane, bistertiarybutylaminosilane, trimethoxymethylsilane, triethoxyethylsilane, trimethoxyethylsilane, triethoxymethylsilane, trimethoxypropylsilane, dimethyldimethoxysilane, dimethyldiethoxysilane, tetramethylcyclotetrasiloxane, octamethylcyclotetrasiloxane, methyltrimethoxysilane, methyltriethoxysilane, methyltripropoxysilane, tetramethoxysilane, tetraethoxysilane, tetrapropoxysilane, and tetrabutoxysilane.

Then, based on the ratio of the number of silicon atoms and the number of carbon atoms in each compound selected as the raw material gas, the ratio of the number of silicon atoms and the number of carbon atoms in the organosiloxane compound to be produced can be adjusted. As a result, the insulating layer 4 containing the organosiloxane compound having a desired C/Si atomic ratio as a main material can be formed.

As an example, a case where three types: trisdimethylaminosilane ($HSi[N(CH_3)_2]_3$), tetramethylcyclotetrasiloxane ($[OSiH(CH_3)]_4$), and octamethylcyclotetrasiloxane ($[OSi(CH_3)_2]_4$) are used as the raw material gases is examined.

In such a case, when the mixing ratio of the three types is set to 1:1:1 in a molar ratio, the C/Si atomic ratio becomes 12/9=1.33.

Further, by increasing the C/Si atomic ratio, the relative permittivity of the insulating layer 4 can be decreased, and by decreasing the C/Si atomic ratio, the relative permittivity of the insulating layer 4 can be increased.

These compounds all have a high vapor pressure even at a low temperature. Therefore, this step can be performed at a relatively low temperature. As a result, when an amorphous material or a microcrystalline material is contained in the soft magnetic material contained in the core portion 2, crystallization of such a material can be prevented from proceeding.

Further, by using two types: the first organosiloxane compound and the second organosiloxane compound, or more compounds are used as the raw material gases, the basic structure of the organosiloxane compound can be adjusted. According to this, even if the organosiloxane compound has a silsesquioxane skeleton, a desired structure can be formed.

2.2.2 Purging of Raw Material Gas S22

When the raw material gas is adsorbed in this manner, the raw material gas in the chamber is discharged. Thereafter, the remaining raw material gas is purged with an inert gas such as nitrogen gas or argon gas as needed. Then, the inert gas is discharged.

2.2.3 Introduction of Oxidizing Agent S23

Subsequently, an oxidizing agent is introduced into the chamber. Examples of the oxidizing agent include water, water vapor, ozone, and oxygen plasma.

The oxidizing agent reacts with the raw material gas adsorbed to the surface of the particle 5 with a foundation layer to form the insulating layer 4. The oxidizing agent also penetrates into a portion behind or a gap to cause reaction in the same manner as the raw material gas, and therefore, the insulating layer 4 having a uniform film thickness can be formed in the end.

2.2.4 Purging of Oxidizing Agent S24

Thereafter, the remaining oxidizing agent is purged with an inert gas as needed. Then, the inert gas is discharged.

Thereafter, an operation in which the raw material gas and the oxidizing agent are sequentially introduced and discharged in the same manner as described above is repeated as needed. By doing this, the film thickness of the insulating layer 4 can be increased. When a plurality of types of compounds are used as the raw material gases, the gases of the respective compounds are sequentially introduced. Therefore, for example, when three types: a first gas, a second gas, and a third gas are used as the raw material gases, an operation of individually introducing and discharging the respective gases, for example, the first gas, the oxidizing agent, the second gas, the oxidizing agent, the third gas, the oxidizing agent, the first gas, and so on, may be performed. Then, the number of times of introduction of each gas may be increased or decreased according to the mixing ratio of each gas.

As described above, the method for producing a magnetic powder according to this embodiment includes the preparation step S1 of preparing the particles 5 with a foundation layer, each including the core portion 2 containing a soft magnetic material and the foundation layer 3 that is provided at a surface of the core portion 2, that contains an oxide of the soft magnetic material, and that has an average thickness of 0.1 nm or more and less than 10 nm, and the insulating layer formation step S2 of forming the insulating layer 4 containing an organosiloxane compound having a C/Si atomic ratio of 0.01 or more and 2.00 or less as a main material by subjecting the particles 5 with a foundation layer to a film formation treatment using a first organosiloxane compound and a second organosiloxane compound having a basic constituent unit different from the first organosiloxane compound as raw materials.

According to the production method as described above, a magnetic powder capable of achieving a high magnetic permeability and easily adjusting the capacitive reactance when producing a powder magnetic core can be efficiently produced.

Further, the film formation treatment in the insulating layer formation step S2 is an atomic layer deposition method as described above. According to the atomic layer deposition method, the insulating layer 4 whose film thickness is controlled with high accuracy can be formed. Therefore, even if it is thin, it has an excellent insulating property between particles, and also the magnetic particles 1 achieving a high magnetic permeability when producing a powder magnetic core can be easily produced. In addition, by using two or more types of raw material gases, the composition of the insulating layer 4 can be controlled with high accuracy. Therefore, the C/Si atomic ratio of the organosiloxane compound that is the main material of the insulating layer 4 can be controlled with high accuracy, and the permittivity involved therewith can be controlled. As a result, the magnetic particles 1 capable of producing a powder magnetic core having a desired capacitive reactance can be efficiently produced.

3. Third Embodiment

Next, a method for producing a magnetic powder according to a third embodiment will be described.

Figure 3:
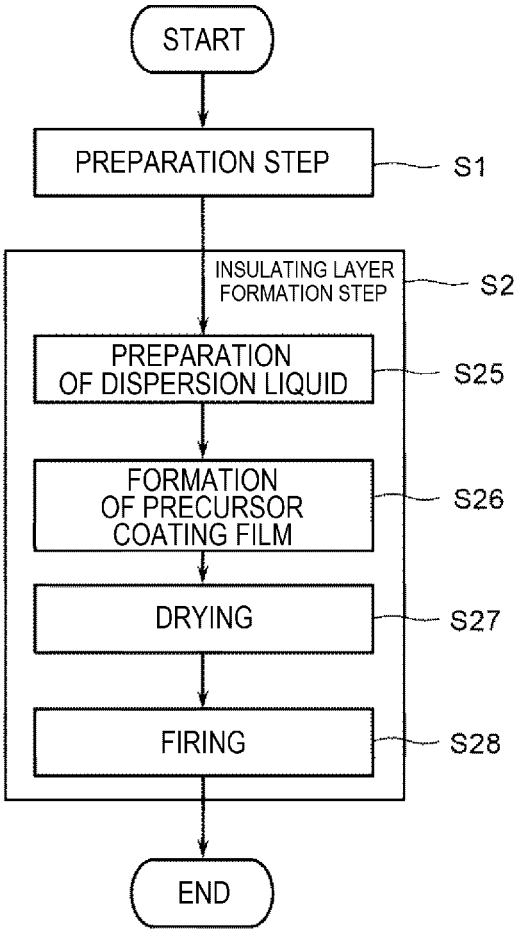
FIG. 3 is a process chart showing a method for producing a magnetic powder according to a third embodiment.

FIG. 3 is a process chart showing the method for producing a magnetic powder according to the third embodiment. In the following description, a method for producing the magnetic particle 1 shown in FIG. 1 will be described as an example.

Hereinafter, the third embodiment will be described, however, in the following description, different points from the second embodiment will be mainly described, and the description of the same matter will be omitted.

The third embodiment is the same as the second embodiment except that the film formation treatment in the insulating layer formation step S2 is different.

As shown in FIG. 3, the method for producing a magnetic powder according to the third embodiment includes a preparation step S1 and an insulating layer formation step S2. Hereinafter, the respective steps will be described.

3.1 Preparation Step S1

First, particles 5 with a foundation layer each including a core portion 2 and a foundation layer 3 are prepared.

3.2 Insulating Layer Formation Step S2

Subsequently, the particles 5 with a foundation layer are subjected to a film formation treatment. By doing this, an insulating layer 4 is formed at the surface of the foundation layer 3. In this manner, the magnetic particles 1 are obtained.

In this embodiment, as one example, the formation of the insulating layer 4 by a wet method will be described.

3.2.1 Preparation of Dispersion Liquid S25

First, a solvent for dissolving the raw material of the insulating layer 4 is prepared. The solvent may be any as long as it can dissolve the raw material.

Subsequently, the particles 5 with a foundation layer are dispersed in the solvent, whereby a dispersion liquid is prepared.

3.2.2 Formation of Precursor Coating Film S26

Subsequently, the raw material is added to the dispersion liquid, followed by stirring. By doing this, a raw material solution is prepared.

As the raw material, a precursor of the material constituting the insulating layer 4 is used in the same manner as in the first embodiment.

As such a first organosiloxane compound and a second organosiloxane compound, a hydrolysable silane compound is preferably used. Specifically, an alkoxysilane-based compound, a silazane-based compound, and the like are exemplified. Among these, as the alkoxysilane-based compound, for example, tetraalkoxysilane, trialkoxysilane, dialkoxysilane, and the like are exemplified. Further, as the silazane-based compound, for example, perhydropolysilazane, polymethylhydrosilazane, poly-N-methylsilazane, poly-N-(triethylsilyl)allylsilazane, poly-N-(dimethylamino)cyclohexylsilazane, phenylpolysilazane, and the like are exemplified.

Among these, the raw material preferably contains tetraalkoxysilane, trialkoxysilane, and dialkoxysilane. When the raw material contains these three types, the C/Si atomic ratio of the organosiloxane compound can be stably adjusted. As a result, the insulating layer 4 that is chemically stable can be efficiently formed.

When three types: tetraalkoxysilane ($Si(OEt)_4$), trialkoxysilane ($SiCH_3$ $(OCH_3)_3$), and dialkoxysilane ($Si(CH_3)_2$ $(OCH_3)_2$) are used as the raw materials and the mixing ratio thereof is set to 1:1:1 in a molar ratio, the C/Si atomic ratio becomes 3/3=1.

In the raw material solution, a reaction product of the raw material and the solvent is adhered to the surfaces of the particles 5 with a foundation layer. Then, the compound contained in the raw material reacts with water or the like in the solvent and is hydrolyzed. As a result, a precursor coating film is formed on the surfaces of the particles 5 with a foundation layer. According to this, precursor-coated particles are obtained.

At that time, based on the ratio of the number of silicon atoms and the number of carbon atoms in each compound selected as the raw material, the ratio of the number of silicon atoms and the number of carbon atoms in the organosiloxane compound to be produced can be adjusted. As a result, the insulating layer 4 containing the organosiloxane compound having a desired C/Si atomic ratio as a main material can be formed in the below-mentioned step.

The concentration of the raw material in the raw material solution is appropriately set according to the film thickness or the like of the insulating layer 4 to be formed, but is preferably 0.01 mass % or more and 50 mass % or less, more preferably 0.1 mass % or more and 20 mass % or less as an example.

Further, to the raw material liquid, various types of additives may be added as needed. Examples of the additive include a reaction catalyst, an ultraviolet absorber, a dispersant, a thickener, and a surfactant. Among these, by using a surfactant, aggregation of the particles 5 with a foundation layer can be suppressed.

3.2.3 Drying S27

Subsequently, the formed precursor-coated particles are taken out from the raw material solution. In order to take out the particles, a solid-liquid separation treatment such as filtration is used.

Subsequently, the taken-out precursor-coated particles are washed and dried.

3.2.4 Firing S28

Subsequently, the dried precursor-coated particles are fired. In the firing, for example, a heating device such as a heating furnace or a hot plate is used. When such firing is performed, a dehydration concentration reaction occurs in the precursor in the precursor coating film. As a result, the precursor coating film is stabilized, and the insulating layer 4 is obtained.

The firing temperature is not particularly limited, but is preferably 30° C. or higher and 300° C. or lower, more preferably 40° C. or higher and 200° C. or lower. If the firing temperature is within such a temperature range, even when an amorphous material or a microcrystalline material is contained in the soft magnetic material contained in the core portion 2, crystallization of such a material can be prevented from proceeding.

Further, the firing time is appropriately set according to the firing temperature, but is preferably, for example, 10 minutes or more and 300 minutes or less, more preferably 20 minutes or more and 200 minutes or less, further more preferably 30 minutes or more and 120 minutes or less.

As the firing atmosphere, for example, an air atmosphere, a water vapor-containing atmosphere, an inert gas atmosphere, and the like are exemplified.

As described above, the method for producing a magnetic powder according to this embodiment includes the preparation step S1 and the insulating layer formation step S2. According to such a production method, the magnetic powder capable of achieving a high magnetic permeability and easily adjusting the capacitive reactance when producing a powder magnetic core can be efficiently produced.

In this embodiment, the film formation treatment in the insulating layer formation step S2 is a wet method. In the wet method, even if it is thin, it has an excellent insulating property between particles, and also the magnetic particles 1 achieving a high magnetic permeability when producing a powder magnetic core can be produced. In addition, by using two or more types of raw materials, the composition of the insulating layer 4 can be controlled with high accuracy. Therefore, the C/Si atomic ratio of the organosiloxane compound that is the main material of the insulating layer 4 can be controlled with high accuracy, and the permittivity involved therewith can be controlled. As a result, the magnetic particles 1 capable of producing a powder magnetic core having a desired capacitive reactance can be efficiently produced.

4. Fourth Embodiment

Next, a coil part according to a fourth embodiment will be described.

Examples of the coil part according to this embodiment include a toroidal coil, an inductor, a reactor, a transformer, a motor, and a generator. Such a coil part includes a powder magnetic core containing the above-mentioned magnetic powder.

Further, the above-mentioned magnetic powder is also used for a magnetic element other than the coil part such as an antenna or an electromagnetic wave absorber.

Hereinafter, as one example of the coil part, a toroidal coil will be described.

Figure 4:
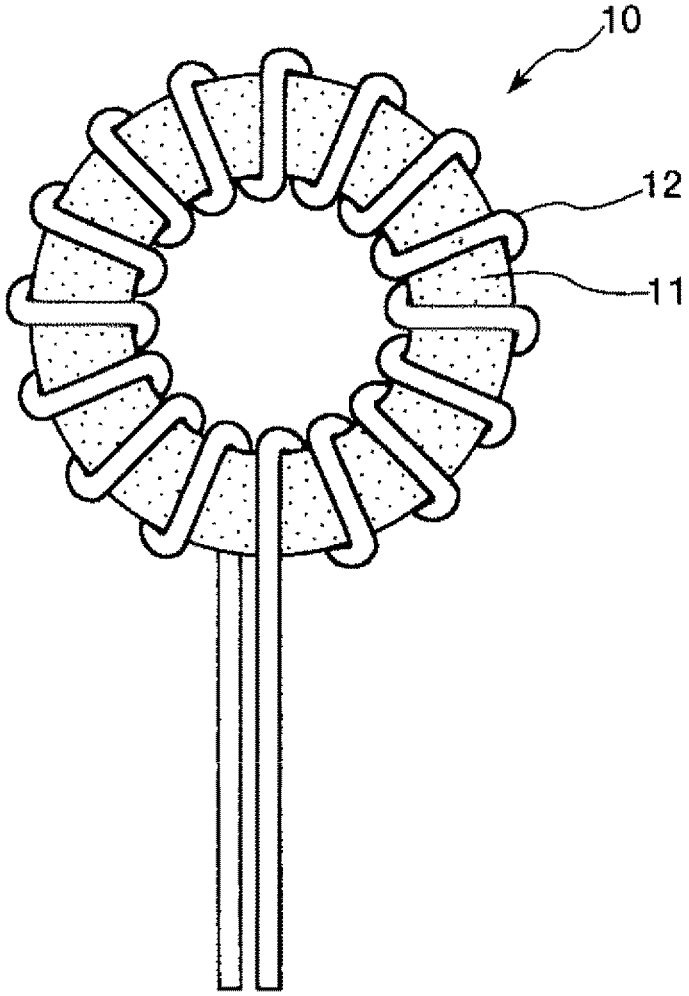
FIG. 4 is a plan view showing a toroidal coil that is a coil part according to a fourth embodiment.

FIG. 4 is a plan view showing a toroidal coil that is the coil part according to the fourth embodiment.

A toroidal coil 10 shown in FIG. 4 includes a powder magnetic core 11 having a ring shape and a conductive wire 12 wound around the powder magnetic core 11.

The powder magnetic core 11 is one obtained by mixing a magnetic powder including the magnetic particles 1 described above and a binder, and then pressing and molding the obtained mixture. That is, the powder magnetic core 11 includes the magnetic powder according to this embodiment. Such a powder magnetic core 11 has a high magnetic permeability, and can easily realize a suitable impedance according to the frequency to be used. Therefore, the toroidal coil 10 suitable for the specification of a circuit to be used can be realized.

Examples of the binder to be used for the powder magnetic core 11 include organic materials such as a silicone-based resin, an epoxy-based resin, a phenolic resin, a polyamide-based resin, a polyimide-based resin, and a polyphenylene sulfide-based resin, and inorganic materials such as phosphates such as magnesium phosphate, calcium phosphate, zinc phosphate, manganese phosphate, and cadmium phosphate, and silicates (liquid glass) such as sodium silicate.

The binder may be used as needed and may be omitted.

On the other hand, as the constituent material of the conductive wire 12, a material having high electrical conductivity is exemplified, and for example, metal materials including Cu, Al, Ag, Au, Ni, and the like are exemplified.

A surface layer having an insulating property is provided at the surface of the conductive wire 12. According to this, a short circuit between the powder magnetic core 11 and the conductive wire 12 can be prevented. Examples of the constituent material of the surface layer include various types of resin materials.

The shape of the powder magnetic core 11 is not limited to the ring shape shown in FIG. 4, and may be a shape in which a part of the ring is missing or may be a rod shape.

The powder magnetic core 11 may contain a magnetic powder other than the magnetic powder according to the above-mentioned embodiment or anon-magnetic powder as needed. In such a case, the mixing ratio of the magnetic powder described above to the other powder is not particularly limited and is arbitrarily set. Further, as the other powder, two or more types may be used.

The toroidal coil 10 that is the coil part according to this embodiment includes the powder magnetic core 11 as described above. Therefore, it is possible to realize the toroidal coil 10 that has a high magnetic permeability and is suitable for the specification of a circuit to be used based on the effect of the powder magnetic core 11 capable of easily realizing a suitable impedance according to the frequency to be used.

5. Fifth Embodiment

Next, a coil part according to a fifth embodiment will be described. Hereinafter, as one example of the coil part, an inductor will be described.

Figure 5:
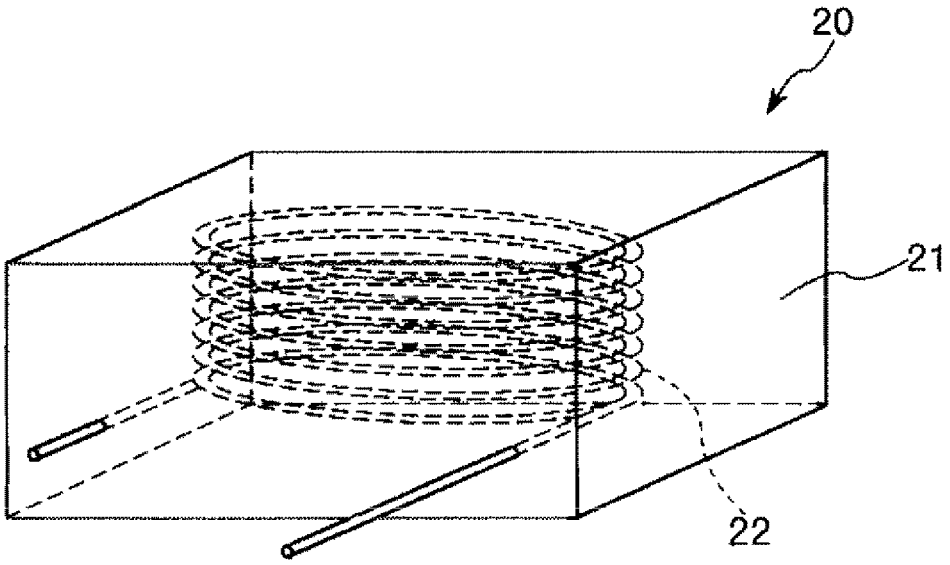
FIG. 5 is a transparent perspective view showing an inductor that is a coil part according to a fifth embodiment.

FIG. 5 is a transparent perspective view showing an inductor that is the coil part according to the fifth embodiment.

Hereinafter, the fifth embodiment will be described, however, in the following description, different points from the fourth embodiment will be mainly described and the description of the same matter will be omitted.

An inductor 20 shown in FIG. 5 is one obtained by embedding a conductive wire 22 molded into a coil shape inside a powder magnetic core 21. That is, the inductor 20 is obtained by molding the conductive wire 22 with the powder magnetic core 21.

The powder magnetic core 21 is the same as the above-mentioned powder magnetic core 11 except that the shape is different. Therefore, it exhibits the same effect as the powder magnetic core 11, and also exhibits an effect that miniaturization is easy.

Further, since the conductive wire 22 is embedded inside the powder magnetic core 21, a gap is hardly generated between the conductive wire 22 and the powder magnetic core 21. According to this, vibration of the powder magnetic core 21 due to magnetostriction is suppressed, and thus, it is also possible to suppress the generation of noise accompanying this vibration.

The inductor 20 that is the coil part according to this embodiment includes the powder magnetic core 21 as described above. Therefore, it is possible to realize the inductor 20 that is small and has a high magnetic permeability, and is suitable for the specification of a circuit to be used based on the effect of the powder magnetic core 21 capable of easily realizing a suitable impedance according to the frequency to be used.

6. Electronic Device and Moving Object

The above-mentioned coil part is also used in various types of electronic devices. Examples of such an electronic device include a personal computer, a cellular phone, a digital still camera, a smartphone, a tablet terminal, a timepiece including a smartwatch, wearable terminals such as a smart glass and HMD (a head-mounted display), a laptop personal computer, a television, a video camera, a videotape recorder, a car navigation device, a pager, an electronic notebook including a communication function, an electronic dictionary, an electronic calculator, an electronic gaming device, a word processor, a work station, a television telephone, a television monitor for crime prevention, electronic binoculars, a POS terminal, medical devices such as an electronic thermometer, a blood pressure meter, a blood sugar meter, an electrocardiogram monitoring device, an ultrasound diagnostic device, and an electronic endoscope, a fish finder, various types of measurement devices, instruments for vehicles, airplanes, and ships, a base station for mobile terminals, and a flight simulator. By including the above-mentioned coil part, an electronic device as described above has high reliability.

Further, the above-mentioned coil part can also be applied to various devices included in various moving objects. Examples of such a device include a keyless entry system, an immobilizer, a car navigation system, a car air conditioner, an anti-lock braking system (ABS), an airbag, a tire pressure monitoring system (TPMS), an engine control unit, a braking system, a battery monitor for hybrid cars or electric cars, a car body posture control system, and an electronic control unit (ECU) such as a self-driving system. By including the above-mentioned coil part, various types of devices included in moving objects as described above have high reliability.

Hereinabove, the present disclosure has been described based on preferred embodiments, but the present disclosure is not limited to these embodiments.

For example, in the magnetic powder, the powder magnetic core, and the coil part according to the present disclosure, the configuration of each portion of the above-mentioned embodiments may be replaced with an arbitrary configuration having the same function, or an arbitrary configuration may be added to the above-mentioned embodiments.

Further, in the method for producing a magnetic powder according to the present disclosure, an arbitrary desired step may be added to the above-mentioned embodiments.

EXAMPLES

Next, specific Examples of the present disclosure will be described.

7. Production of Magnetic Powder

Example 1

First, a metal powder (core portion) of an Fe—Si—Cr-based alloy was prepared. This metal powder is an Fe-based alloy soft magnetic powder containing Si and Cr. The average particle diameter D50 of the metal powder was 11 μm.

Subsequently, the metal powder was introduced into a vacuum chamber for an atomic layer deposition method, and the powder was fixed by a neodymium magnet. Then, the powder was subjected to an oxidation treatment with ozone, whereby particles with a foundation layer were obtained. In the foundation layer, an Fe oxide, a Si oxide, and a Cr oxide were contained. The thickness of the foundation layer is shown in Table 1.

Subsequently, as the raw material gases, three types: trisdimethylaminosilane, tetramethylcyclotetrasiloxane, and octamethylcyclotetrasiloxane were used, and the mixing ratio of the respective raw material gases was set so that the C/Si atomic ratio becomes a value shown in Table 1, and film formation was sequentially performed by an atomic layer deposition (ALD) method. As an oxidizing agent, water was used. By this film formation, an insulating layer containing an organosiloxane compound as a main material was formed, whereby a magnetic powder was obtained. In the organosiloxane compound, an alkyl-modified silsesquioxane skeleton was included.

Examples 2 to 8

Magnetic powders were obtained in the same manner as in Example 1 except that the production conditions were changed as shown in Table 1, respectively.

Example 9

First, a metal powder (core portion) of an Fe—Si—Cr-based alloy was prepared. This metal powder is an Fe-based alloy soft magnetic powder containing Si and Cr. The average particle diameter of the metal powder was 3 μm.

Subsequently, the obtained metal powder was introduced into a vacuum chamber, and the powder was fixed by a neodymium magnet. Then, the powder was subjected to an oxidation treatment with ozone, whereby particles with a foundation layer were obtained. In the foundation layer, an Fe oxide, a Si oxide, and a Cr oxide were contained. The thickness of the foundation layer is shown in Table 1.

Subsequently, as the raw material gases, three types: tetraalkoxysilane, trialkoxysilane, and dialkoxysilane were used, and the mixing ratio of the respective raw materials was set so that the C/Si atomic ratio becomes a value shown in Table 1, and film formation was sequentially performed by a wet method. By this film formation, a precursor coating film containing an organosiloxane compound as a main material was formed, whereby precursor-coated particles were obtained.

Thereafter, the precursor-coated particles were taken out, washed, and then dried. Then, the particles were fired at 200° C. so as to convert the precursor coating film to an insulating layer, whereby a magnetic powder was obtained.

Examples 10 to 12

Magnetic powders were obtained in the same manner as in Example 9 except that the production conditions were changed as shown in Table 1, respectively.

Comparative Examples 1 and 2

Magnetic powders were obtained in the same manner as in Example 1 except that the production conditions were changed as shown in Table 1, respectively.

Comparative Example 3

A magnetic powder was obtained in the same manner as in Example 5 except that the oxidation treatment with ozone was omitted.

Comparative Examples 4 and 5

Magnetic powders were obtained in the same manner as in Example 9 except that the production conditions were changed as shown in Table 1, respectively.

Comparative Example 6

A magnetic powder was obtained in the same manner as in Example 9 except that the oxidation treatment with ozone was omitted.

8. Evaluation of Insulating Layer 8.1 Measurement of C/Si Atomic Ratio

With respect to the insulating layers obtained in the respective Examples and the respective Comparative Examples, the C/Si atomic ratio was measured by X-ray photoelectron spectroscopy (XPS). The measurement results are shown in Table 1.

8.2 Measurement of Relative Permittivity

An insulating layer was formed on a copper electrode in the same manner as in each of the respective Examples and the respective Comparative Examples. By doing this, thin-film samples for measuring the permittivity of the insulating layer were obtained.

Subsequently, with respect to the obtained thin-film samples, the relative permittivity was measured using an impedance analyzer. The measurement results are shown in Table 1.

9. Evaluation of Powder Magnetic Core 9.1 Measurement of Magnetic Permeability

A powder magnetic core was produced by mixing the magnetic powder obtained in each of the respective Examples and the respective Comparative Examples and an epoxy resin, and then compacting the powder into a ring shape. Subsequently, with respect to the obtained powder magnetic cores, the magnetic permeability was measured under the following measurement conditions.

Measurement Conditions for Magnetic Permeability

Measurement device: impedance analyzer

Measurement frequency: 100 kHz

Number of turns of coil wire: 7

Diameter of coil wire: 0.5 mm

Subsequently, the obtained magnetic permeability was evaluated according to the following evaluation criteria.

Evaluation Criteria for Magnetic Permeability

A: The magnetic permeability of the powder magnetic core is high.

B: The magnetic permeability of the powder magnetic core is slightly high.

C: The magnetic permeability of the powder magnetic core is slightly low.

D: The magnetic permeability of the powder magnetic core is low.

The evaluation results are shown in Table 1.

9.2 Measurement of Electrical Characteristics

With respect to the powder magnetic cores obtained in 9.1, the impedance was measured under the following measurement conditions.

Measurement Conditions for Impedance

Measurement device: impedance analyzer

Measurement frequency: 100 kHz

Number of turns of coil wire: 7

Diameter of coil wire: 0.5 mm

Subsequently, the obtained impedance was evaluated according to the following evaluation criteria.

Evaluation Criteria for Impedance

A: The impedance is high.

B: The impedance is slightly high.

C: The impedance is slightly low.

D: The impedance is low.

The evaluation results are shown in Table 1.

TABLE 1

| | | | Foundation | Insulating layer | | Insulating layer | Powder magnetic core | |
|---|---|---|---|---|---|---|---|---|
| | Production method | Main material of insulating layer | layer Thickness nm | C/Si atomic ratio — | Thickness nm | relative permittivity — | magnetic permeability — | electrical characteristic — |
| Example 1 | ALD method | alkyl-modified silsesquioxane | 8 | 0.02 | 30 | 3.0 | A | B |
| Example 2 | ALD method | alkyl-modified silsesquioxane | 7 | 0.05 | 30 | 2.9 | A | B |

TABLE 1-continued

| | Production method | Main material of insulating layer | Foundation layer Thickness nm | Insulating layer C/Si atomic ratio — | Insulating layer Thickness nm | Insulating layer relative permittivity — | Powder magnetic core magnetic permeability — | Powder magnetic core electrical characteristic — |
|---|---|---|---|---|---|---|---|---|
| Example 3 | ALD method | alkyl-modified silsesquioxane | 5 | 0.2 | 30 | 2.7 | A | B |
| Example 4 | ALD method | alkyl-modified silsesquioxane | 3 | 0.75 | 30 | 2.5 | A | A |
| Example 5 | ALD method | alkyl-modified silsesquioxane | 5 | 1.0 | 30 | 2.3 | A | A |
| Example 6 | ALD method | alkyl-modified silsesquioxane | 9 | 1.3 | 30 | 2.1 | A | A |
| Example 7 | ALD method | alkyl-modified silsesquioxane | 6 | 1.9 | 30 | 1.9 | A | A |
| Example 8 | ALD method | fluoroorganosiloxane | 5 | 1.0 | 30 | 1.7 | A | A |
| Example 9 | Wet method | alkyl-modified organosiloxane | 4 | 1.0 | 30 | 2.5 | A | A |
| Example 10 | Wet method | alkyl-modified organosiloxane | 5 | 1.0 | 30 | 2.5 | A | A |
| Example 11 | Wet method | alkyl-modified organosiloxane | 6 | 1.3 | 30 | 2.3 | A | A |
| Example 12 | Wet method | alkyl-modified organosiloxane | 8 | 1.3 | 30 | 2.3 | A | A |
| Comparative Example 1 | ALD method | alkyl-modified silsesquioxane | 9 | 0.005 | 30 | 4.0 | A | D |
| Comparative Example 2 | ALD method | alkyl-modified silsesquioxane | 20 | 1.3 | 30 | 2.1 | D | A |
| Comparative Example 3 | ALD method | alkyl-modified silsesquioxane | 0 | 1.0 | 30 | 2.3 | A | C |
| Comparative Example 4 | Wet method | alkyl-modified organosiloxane | 9 | 0.005 | 30 | 4.0 | A | D |
| Comparative Example 5 | Wet method | alkyl-modified organosiloxane | 20 | 1.3 | 30 | 2.3 | D | A |
| Comparative Example 6 | Wet method | alkyl-modified organosiloxane | 0 | 1.0 | 30 | 2.5 | A | C |

As apparent from Table 1, in the respective Examples, by changing the mixing ratio of the compounds to serve as the raw materials, the relative permittivity could be adjusted. Therefore, the magnetic powder produced using such raw materials can adjust the capacitive reactance of the powder magnetic core. Further, it was also confirmed that in the respective Examples, a powder magnetic core having a high magnetic permeability can be produced. Moreover, it was also confirmed that in the respective Examples, by providing a relatively thin foundation layer, the impedance can be increased without decreasing the magnetic permeability.

What is claimed is:

1. A magnetic powder, comprising:

a core portion containing a soft magnetic material;

a foundation layer that is provided at a surface of the core portion, that contains an oxide of the soft magnetic material, and that has an average thickness of 0.1 nm or more and less than 10 nm; and an insulating layer that is provided at a surface of the foundation layer, and that contains an organosiloxane compound as a main material, wherein the organosiloxane compound has a C/Si atomic ratio of 0.01 or more and 2.00 or less, and a ratio of a relative permittivity of the insulating layer to an average thickness of the insulating layer is 0.033/nm or more and 3.2/nm or less.

2. The magnetic powder according to claim 1, wherein the average thickness of the insulating layer is 60 nm or less.

3. The magnetic powder according to claim 1, wherein the relative permittivity of the insulating layer is 1.0 or more and 3.2 or less.

4. The magnetic powder according to claim 1, wherein the organosiloxane compound contains a silsesquioxane compound.

5. The magnetic powder according to claim 1, wherein the insulating layer contains a fluorine atom.

6. The magnetic powder according to claim 5, wherein the organosiloxane compound contains a fluorine-containing group.

7. The magnetic powder according to claim 1, wherein the soft magnetic material contains an amorphous material.

8. A method for producing a magnetic powder, comprising:

preparing a particle with a foundation layer including a core portion containing a soft magnetic material, and a foundation layer that is provided at a surface of the core portion, that contains an oxide of the soft magnetic material, and that has an average thickness of 0.1 nm or more and less than 10 nm; and forming an insulating layer containing an organosiloxane compound having a C/Si atomic ratio of 0.01 or more and 2.00 or less as a main material by subjecting the particle with a foundation layer to a film formation treatment using a first organosiloxane compound and a second organosiloxane compound having a basic constituent unit different from the first organosiloxane compound as raw materials, wherein a ratio of a relative permittivity of the insulating layer to an average thickness of the insulating layer is 0.033/nm or more and 3.2/nm or less.

9. The method for producing a magnetic powder according to claim 8, wherein the raw materials include tetraalkoxysilane, trialkoxysilane, and dialkoxysilane.

10. The method for producing a magnetic powder according to claim 8, wherein the film formation treatment is an atomic layer deposition method or a wet method.

11. A powder magnetic core, comprising the magnetic powder according to claim 1.

12. A coil part, comprising the powder magnetic core according to claim 11.

* * * * *